United States Patent [19]

Reed

[11] 4,222,625

[45] Sep. 16, 1980

[54] HIGH VOLTAGE ELECTRICAL CONNECTOR SHIELD CONSTRUCTION

[75] Inventor: Anthony Reed, Port Murray, N.J.

[73] Assignee: Amerace Corporation, New York, N.Y.

[21] Appl. No.: 974,084

[22] Filed: Dec. 28, 1978

[51] Int. Cl.[3] ..... H01R 13/52; H01R 15/06

[52] U.S. Cl. ..... 339/143 C; 339/111

[58] Field of Search ..... 339/111, 143 R, 143 C, 339/14 R, 14 L, 60 R; 174/73 R

[56] References Cited

U.S. PATENT DOCUMENTS

| | | | |
|---|---|---|---|
| 3,323,097 | 5/1967 | Tordoff | 339/143 X |
| 3,725,846 | 4/1973 | Strain | 339/143 C X |
| 4,067,636 | 1/1978 | Boliver et al. | 339/143 C |
| 4,082,404 | 4/1978 | Flatt | 339/111 |

*Primary Examiner*—Roy Lake
*Assistant Examiner*—Eugene F. Desmond
*Attorney, Agent, or Firm*—Arthur Jacob; Richard A. Craig

[57] ABSTRACT

A shielded electrical connector for use in connecting a high voltage cable to a high voltage bushing has a receptacle at one end of the connector for receiving the bushing, a contact for connection to the bushing and a shield construction which includes a conductive sleeve at the one end of the connector and extending circumferentially around the receptacle, the sleeve extending axially along the connector and being electrically separated from the remainder of the shield such that upon energization the electrical potential difference between the contact and the sleeve is less than the electrical potential difference between the contact and the remainder of the shield.

17 Claims, 2 Drawing Figures

HIGH VOLTAGE ELECTRICAL CONNECTOR SHIELD CONSTRUCTION

Figure 1:
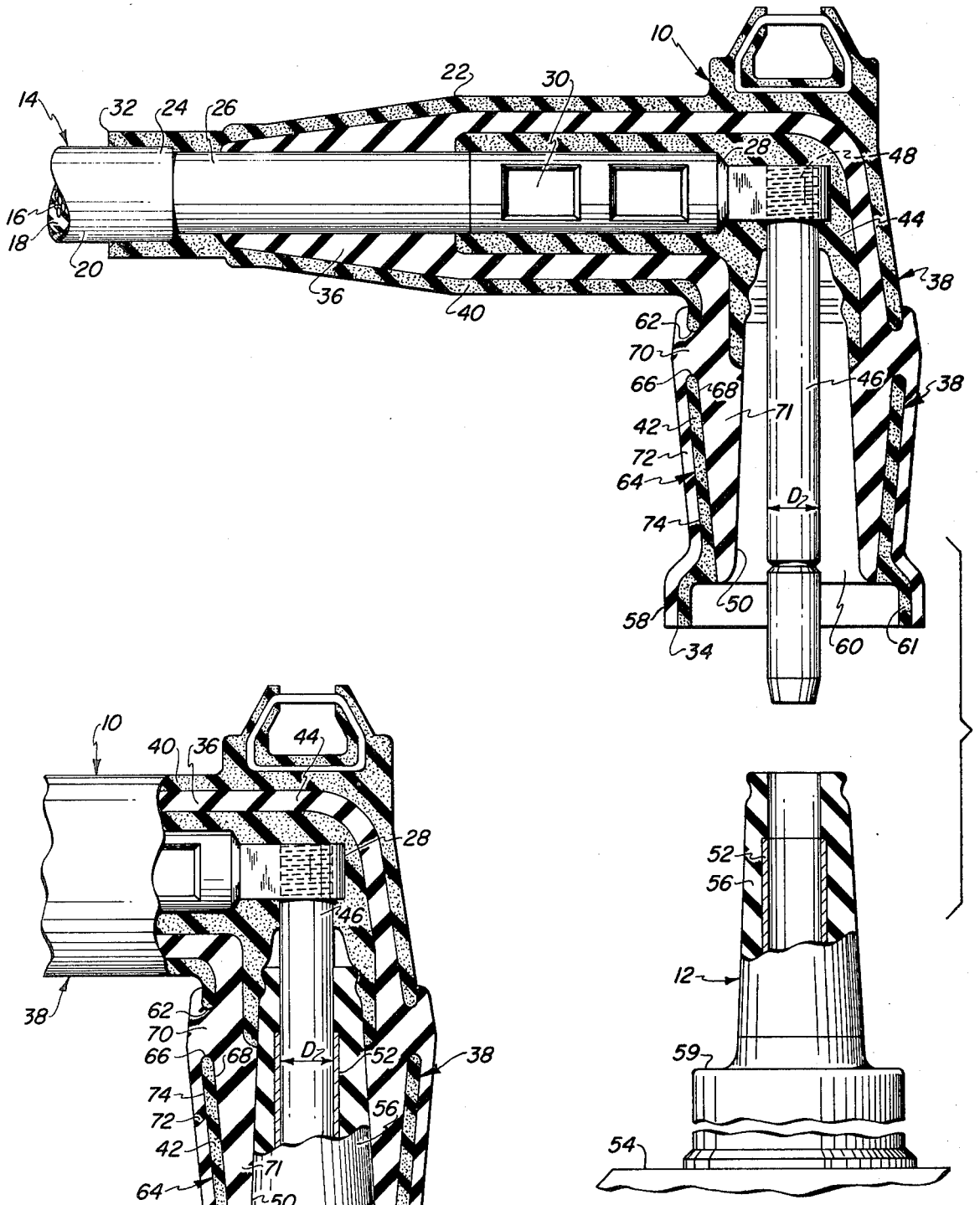

The present invention relates generally to shielded high voltage electrical connectors and pertains, more specifically, to a shield construction which enables use of such a connector at higher voltages without the presence of the deleterious effects of corona when the connector is unconnected and is energized under high voltage conditions.

In recent years, heavy emphasis has been placed upon the development of underground electrical power distribution systems, especially in light industrial, commercial and residential areas. Various power distribution components, such as shielded high voltage electrical cables, transformers and electrical connectors have been evolved for use in such systems. Among these components, shielded electrical connectors have been developed which are assembled early in the field at the terminal ends of electrical cables so as to facilitate the construction and installation of underground power distribution systems. The numerous advantages of such connectors have given rise to the demand for simplified connectors which will operate successfully at even higher voltages than those already accommodated by earlier connectors.

Devices have been developed which enable the safe connection or disconnection of shielded high voltage electrical connectors, such as a connector elbow, with a high voltage terminal, such as a bushing, under load conditions. However, in operations at higher ratings, in excess of 35 Kv, for example, corona can develop in the energized unconnected connector due to the high electrical stresses across the gap between the contact pin and the shield of the unconnected connector. The result is an undue amount of noise, as well as other deleterious effects.

It is an object of the present invention to provide a shielded electrical connector for high voltage connections, the connector having a shield construction which reduces the electrical stresses between the connector contact and the connector shield while the connector is unconnected and is energized under high voltage conditions.

Another object of the invention is to provide a shielded electrical connector having a simplified shield construction which eliminates or reduces corona noise in an unconnected connector which is energized at higher voltages.

Still another object of the invention is to provide a shielded electrical connector of the type described and capable of ready installation in the field at the terminus of a high voltage power distribution cable.

Yet another object of the invention is to provide a shielded electrical connector of the type described and having a structure compatible with present related components.

A further object of the invention is to provide a shielded electrical connector of the type described and having a construction which enables ready fabrication utilizing present manufacturing techniques.

A still further object of the invention is to provide a shielded electrical connector of the type described which is economically fabricated in large numbers of uniform high quality.

The above objects, as well as still further objects and advantages, are attained by the present invention which may be described briefly as providing, in a shielding system for an electrical connector having a housing including a first end for engagement with a high voltage electrical cable and a second end carrying an electrical contact element for connection with a high voltage terminal, the improvement comprising: a shield extending along the housing, the shield including a first portion adjacent the first end of the housing and a second portion adjacent the second end of the housing; and the second portion of the shield being electrically separated from the first portion such that the electrical potential difference between the contact element and the second portion of the shield, under energized conditions, will be less than the electrical potential difference between the contact element and the first portion of the shield.

Figure 2:
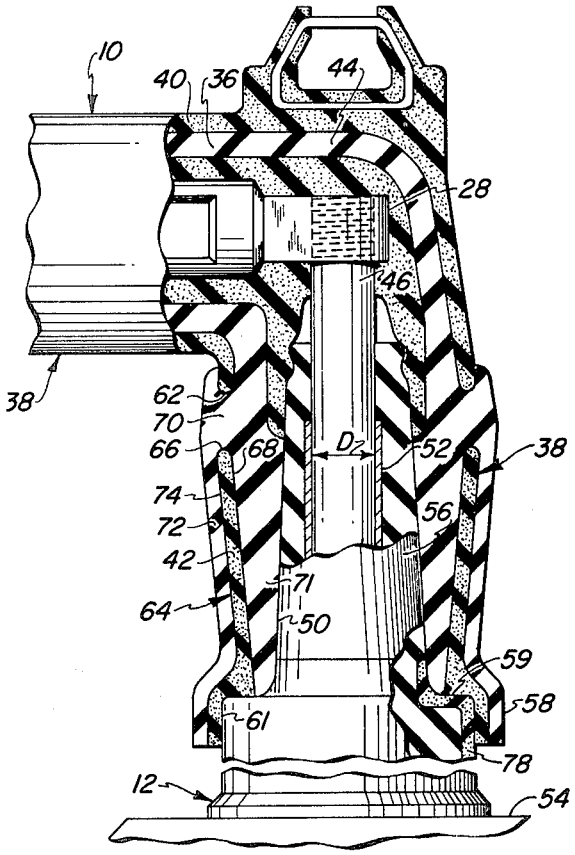

The invention will be more fully understood, while still further objects and advantages will become apparent, in the following detailed description of a preferred embodiment illustrated in the accompanying drawing, in which:

FIG. 1 is a longitudinal, cross-sectional view of an electrical connector constructed in accordance with the invention, installed at the terminus of a high voltage electrical cable and about to be connected to a high voltage terminal; and FIG. 2 is a fragmentary view of the components of FIG. 1, connected.

Referring now to the drawing, an electrical connector constructed in accordance with the invention is illustrated in the form of connector elbow 10 which is about to be connected to a high voltage terminal in the form of a bushing 12. Connector elbow 10 is installed at the terminus of a high voltage electrical cable 14 which has a conductor 16, insulation 18 and an external shield 20.

Connector elbow 10 includes a housing 22 which is installed over the end 24 of the shield 20, bared portion 26 of the insulation 18, and a terminal 28 which is electrically connected and mechanically secured to conductor 16 of cable 14 by means of a crimped connection between the barrel 30 of terminal 28 and the conductor 16. Housing 22 extends axially between a first end 32 and a second end 34 and is molded of elastomeric materials. A first member 36 of housing 22 is molded of an insulating elastomer and extends throughout almost the entire length of housing 22. An external shielding system is provided by a shield 38 constructed of a conductive elastomer in the form of second and third members 40 and 42 molded integral with first member 36. An internal shield is provided by a fourth member 44 of conductive elastomeric material molded integral with the first member 36.

Housing 22 is installed readily at the terminus of cable 14 in a now well-known manner. That is, housing 22 is slipped over the cable terminus so that the first member 36 grips the bared portion 26 of insulation 18 and second member 40 grips the cable shield 20 adjacent the first end 32 of the housing to establish the appropriate insulated connection while continuing the shield along the housing. An electrical contact element in the form of a conductive pin 46 is secured to the terminal 28 by means of a threaded connection 48 and extends axially within a recess 50 located adjacent the second end 34 of the housing 22 and extending axially into the housing to establish a receptacle for receiving the bushing 12. Pin 46 has given external diameter D which is complementary to the internal diameter of a socket 52 which serves as the electrical contact element of bushing 12.

Bushing 12 is the terminal of a high voltage transformer 54 and includes an insulator 56 surrounding the socket 52. When a connection is established between electrical connector 10 and bushing 12, as seen in FIG. 2, pin 46 makes contact with socket 52 and insulator 56 is seated within recess 50. An annular cuff 58 at the second end 34 of the housing 22 engages a complementary shoulder 59 of the bushing 12.

In the unconnected state illustrated in FIG. 1, the circuit which includes cable 14 and connector elbow 10 is energized so that connector elbow 10 is placed under high voltage conditions. Electrical stresses therefore are established across a gap 60 between contact pin 46 and shield 38, and especially between pin 46 and the shield 38 at portion 61 of cuff 58. In conventional connector elbows, the shield of the connector elbow is grounded and, when the circuit which includes the cable is energized, the electrical potential difference across the gap between the contact pin and the shield is a function of the potential at the pin and ground potential. Under high potential conditions, such as 35 Kv and upwards, the electrical stresses across the gap between the contact pin and the shield in a conventional connector elbow will cause corona. The corona engenders an objectionable crackling noise as well as other deleterious effects.

In order to eliminate the unwanted effects of corona in an unconnected connector, as illustrated at 10 in FIG. 1, when cable 14 is energized so that connector 10 is under high voltage conditions, the shield 38 is constructed in two portions, shown in the form of second and third members 40 and 42, with the third member 42 being separated electrically from the second member 40. In this manner, the third member is not grounded and the electrical stress across gap 60 is reduced. Thus, the second member 40, which extends axially from first end 32 toward second end 34 of housing 22 and circumferentially around first member 36, terminates at a terminal end 62, short of the second end 34, while the third member 42, shown in the form of a sleeve 64 also extending circumferentially around first member 36, extends axially from second end 34 toward first end 32 and terminates at a terminal edge 66 confronting terminal end 62 of second member 40 and is spaced axially therefrom. Sleeve 64 is coaxial with pin 46, has an inner surface 68 spaced radially from the pin 46 and from recess 50, and extends axially along a major portion of the axial length of recess 50. Because of the spacing between sleeve 64 and the remainder of the shield, in the form of second member 40, the sleeve 64 is separated electrically from the remainder of the shield. Hence, under energized conditions, with second member 40 grounded and pin 46 at a high electrical potential, the potential of sleeve 64 will rise, as a result of capacitance coupling between the pin 46 and sleeve 64, thereby reducing the potential difference between pin 46 and sleeve 64, with a concommitant reduction in electrical stress across gap 60. Corona is thereby reduced or entirely eliminated.

Because there will be a difference in electrical potential between sleeve 64 and second member 40, first member 36 is constructed to provide insulation between the second and third members 40 and 42. Thus, a portion 70 of first member 36 is placed between the confronting terminal end 62 and terminal edge 66. A further portion 71 of first member 36 extends axially along the inner surface 68 of sleeve 64 and terminates short of second end 34 to expose conductive portion 61 of cuff 58. Additionally, a sheath-like portion 72 of first member 36 extends axially along outer surface 74 of sleeve 64 to insulate against flash-over to the second member 40 and to protect operators against the voltage induced in sleeve 64, when the circuit is energized.

Upon connection of the connector elbow 10 to the bushing 12, as seen in FIG. 2, cuff 58 engages shoulder 59 and the cuff portion 61 of sleeve 64 makes contact with a grounded shield 78 on the bushing 12, bringing the entire shield 38 to ground potential. The spacing between the confronting terminal end 62 and terminal edge 66 is minimal and does not disturb the integrity and function of the shielding system in the completed connection.

The magnitude of the axial spacing between the second and third members 40 and 42 is great enough to assure that the second and third members 40 and 42 are electrically insulated from one another. However, the axial spacing should be kept small enough so as not to disturb the integrity and function of the shielding system in the completed connection. An appropriate magnitude for the spacing between the confronting terminal end 62 and the terminal edge 66 is of the same order of magnitude as diameter D of pin 46.

It will be seen that the structure of connector elbow 10 is changed only slightly from the construction of present, conventional connector elbows, but the change enables that structure to be used readily at higher voltages. Hence, the manufacture and use of connector elbow 10 can be accomplished economically and with ease, while attaining the advantages of extending the useful range of application.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a shielding system for an electrical connector having a housing including a first end for engagement with a high voltage electrical cable and a second end carrying an electrical contact element for connection with a high voltage terminal, the improvement comprising:

a shield extending along the housing, the shield being electrically separated from the electrical contact element and including a first portion adjacent the first end of the housing and a second portion adjacent the second end of the housing;

the second portion of the shield being electrically separated from the first portion such that the electrical potential difference between the contact element and the second portion of the shield, under energized conditions, will be less than the electrical potential difference between the contact element and the first portion of the shield.

2. The invention of claim 1 wherein the housing extends axially between the first and second ends, and the first and second portions of the shield are spaced axially from one another.

3. The invention of claim 1 or 2 wherein:

the second end of the housing includes an axially extending receptacle;

the electrical contact element comprises a conductive pin of given diameter extending axially within the receptacle; and the second portion of the shield extends axially along at least a major portion of the axial length of the receptacle, coaxial therewith, and spaced radially therefrom.

4. The invention of claim 3 wherein the housing is molded of elastomeric materials including an insulating elastomer, and the shield portions are of a conductive elastomer molded integral with the insulating elastomer.

5. The invention of claim 3 wherein the axial spacing between the first and second portions of the shield is of the same order of magnitude as the given diameter of the pin.

6. An electrical connector for installation at the terminus of a high voltage electrical cable to enable connection of the cable conductor to a conductive element in a high voltage terminal, the connector comprising:

a housing extending axially between first and second ends and having a first member of insulating material and a second member of conductive material integral with the first member, the second member extending from the first end toward the second end and terminating at a terminal end short of the second end of the first member to extend circumferentially around at least a portion of the first member and provide a conductive shield;

a receptacle in the first member at the second end of the housing for receiving the high voltage terminal;

an electrical contact element for extending axially within the receptacle to be connected electrically to the cable conductor;

a third member of conductive material extending along the first member from adjacent the second end of the housing toward the first end thereof for providing a further conductive shield, the third member having a terminal edge confronting the terminal end of the second member and spaced therefrom, at a location spaced axially from the second end of the housing, the third member being spaced radially from and extending circumferentially around at least a portion of the first member and at least a portion of the electrical contact element so as to be electrically insulated by the first member from the electrical contact element and the second member, such that upon energization of the cable the electrical potential difference between the electrical contact element and the third member will be less than the electrical potential difference between the electrical contact element and the second member.

7. The invention of claim 6 wherein the third member extends axially along a major portion of the axial length of the receptacle.

8. The invention of claim 7 wherein at least the first and second members are elastomeric materials molded integral with one another.

9. The invention of claim 8 wherein the third member is a sleeve of elastomeric material molded integral with the first member.

10. The invention of claim 9 wherein the high voltage terminal is a bushing and the sleeve of elastomeric material includes an annular cuff at the second end of the housing for engaging the bushing.

11. The invention of claim 9 wherein the sleeve has radially inner and outer surfaces and the first member includes a first portion extending along the inner surface and contiguous therewith.

12. The invention of claim 11 wherein the first member includes a second portion extending along the outer surface of the sleeve and contiguous therewith.

13. The invention of claim 11 wherein:

the high voltage terminal is a bushing;

the sleeve includes an annular cuff at the second end of the housing; and the inner surface of the sleeve extends axially beyond the first portion of the first member for engaging the bushing.

14. The invention of claim 13 wherein the first member includes a second portion extending along the outer surface of the sleeve and contiguous therewith.

15. The invention of claim 6, 7, 8, 9, 10, 11, 12, 13 or 14 wherein the third member is spaced axially from the second member.

16. The invention of claim 15 wherein:

the electrical contact element includes a conductive pin of given diameter extending along a central axis;

the receptacle includes a recess in the first member, the recess extending coaxially with the pin; and the third member is generally tubular and extends coaxially with the pin and the recess.

17. The invention of claim 16 wherein the axial spacing between the second and third members is of the same order of magnitude as the given diameter of the pin.

* * * * *